United States Patent [19]

Purtell et al.

[11] 4,246,575

[45] Jan. 20, 1981

[54] MOISTURE DETECTOR

[76] Inventors: Jack L. Purtell; Rufus J. Purtell, both of P.O. Box 1152, Brownfield, Tex. 79316

[21] Appl. No.: 8,494

[22] Filed: Feb. 2, 1979

[51] Int. Cl.[2] ..... G08B 21/00

[52] U.S. Cl. ..... 340/605; 200/61.04; 340/604

[58] Field of Search ..... 340/604, 605; 73/40; 200/61.04, 61.05, 61.06

[56] References Cited

U.S. PATENT DOCUMENTS

| | | | |
|---|---|---|---|
| 2,432,367 | 12/1947 | Andresen | 340/605 |
| 3,200,388 | 8/1965 | Uhlig | 340/604 |
| 3,562,731 | 2/1971 | Hsu | 340/604 |

FOREIGN PATENT DOCUMENTS

| | | | |
|---|---|---|---|
| 380383 | 9/1932 | United Kingdom | 200/61.04 |

*Primary Examiner*—John W. Caldwell, Sr.
*Assistant Examiner*—Daniel Myer
*Attorney, Agent, or Firm*—Wendell Coffee

[57] ABSTRACT

A compressed dehydrated cellulose sponge wafer has conductive plates attached to opposing faces. A bridging conductor electrically connects the two plates together upon swelling of the wafer responsive to its contact with moisture. One edge of the sponge is treated with adhesive so as to form a hinge. The wafer opens like a book upon contact with moisture forcing the extending plates into contact.

4 Claims, 4 Drawing Figures

Fig. 1
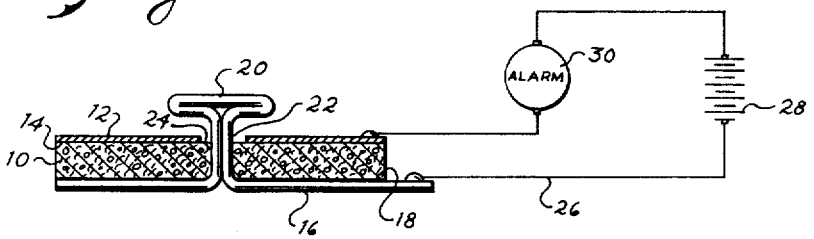
Fig. 2
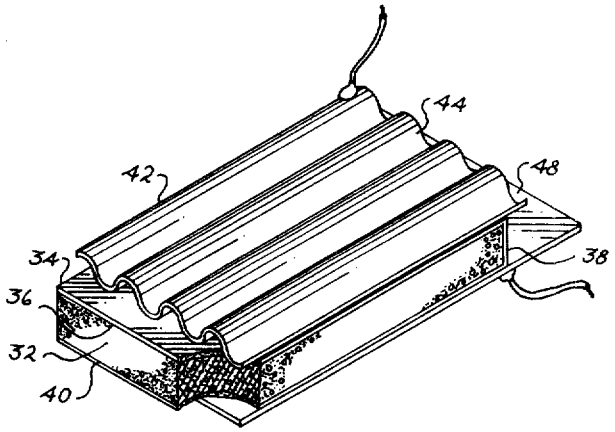
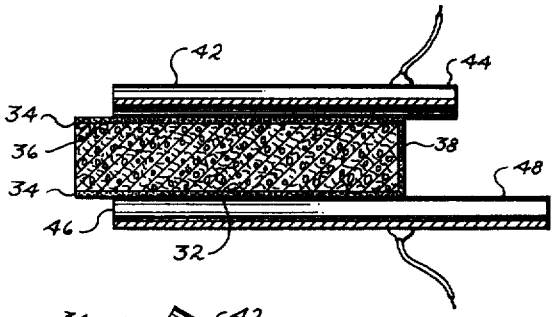
Fig. 3
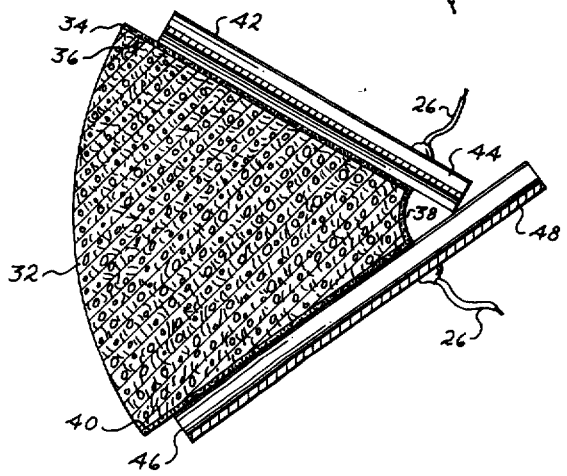
Fig. 4

MOISTURE DETECTOR

CROSS REFERENCE TO RELATED APPLICATIONS

None. However, applicants filed two Disclosure Documents which are Disclosure Document No. 074,588 filed on Sept. 27, 1978 and Disclosure Document No. 074,486 filed on Sept. 25, 1978, which documents concern this application.

BACKGROUND OF THE INVENTION (1) Field of the Invention

This invention relates to electrical alarms which are actuated by the presence of moisture.

(2) Description of the Prior Art

In modern homes expensive carpets are often laid above concrete floors. Also, often hot water heaters are located near the center of the house so that they are near bathrooms and the like. When leaks occur in this or other water using applicances, the water can ruin the carpets upon the floor.

Previous workers have designed alarms to detect the moisture in this and similar situations. The previous workers have suggested using an expansion material, which upon expansion, would close electrical contacts. Normally, the expansion material was in a confined space so that its expansion pushed one electrical contact against the other by compression. SHU, U.S. Pat. No. 3,562,731, ANDRESEN U.S. Pat. No. 2,423,367 and UHLIG U.S. Pat. No. 3,200,388 disclose such detectors.

Other alarm systems for the home have received extensive development. Specifically, fire and smoke alarms have been developed to respond to a change in conditions as detected to sound an alarm from a battery operated energy source.

SUMMARY OF THE INVENTION (1) New and Different Function

We have invented a new and improved method and means for detecting the presence of moisture and closing an electrical contact thereby. The prior art discloses excellent equipment whereby an alarm may be sounded once the moisture is detected and the contacts closed.

We have discovered that a very inexpensive detector can be made using a compressed dehydrated cellulose sponge which expands upon contact with the water as is known to the prior art. However, we have invented covering the faces and at least one edge of a wafer or plate-like block of the sponge with an adhesive. By covering one edge with adhesive, this presents that edge from expanding. Therefore, when the bulk of the material expands, it causes the sponge to fan open much like a book or a clam. If a conductive plate attached to the faces extends beyond the hinge edge, the opening will force the extensions into contact with a certain leverage action which will increase the pressure by which the conductive plates are pushed together.

Therefore it may be seen that we have invented a device which is very inexpensive to manufacture and also has an extremely long storage life.

Thus it may be seen that the total function of our complete device far exceeds the functions of the individual elements, i.e., the adhesive, sponge, plates, etc.

(2) Objects of this Invention

An object of this invention is to detect the presence of water.

Further objects are to achieve the above with a device that has a long shelf life, is sturdy, compact, durable, lightweight, simple, safe, efficient, versatile, ecologically compatible, energy conserving, and reliable, yet inexpensive and easy to manufacture, install, adjust, operate and maintain.

Other objects are to achieve the above with a method that is versatile, ecologically compatible, energy conserving, rapid, efficient, and inexpensive, and does not require skilled people to install, adjust, operate, and maintain.

The specific nature of the invention, as well as other objects, uses, and advantages thereof, will clearly appear from the following description and from the accompanying drawing, the different views of which are not scale drawings.

BRIEF DESCRIPTION OF THE DRAWINGS

FIG. 1 is a cross sectional view of an embodiment of this invention schematically shown connected to a battery and an alarm.

FIG. 2 is a perspective view of the preferred embodiment of this invention.

FIG. 3 is a sectional view of the preferred embodiment in the dry, waiting condition.

FIG. 4 is a sectional view of this device in the moist, alarm condition.

DESCRIPTION OF THE PREFERRED EMBODIMENTS

Referring to FIG. 1, there may be seen a block or plate or wafer of compressed dehydrated cellulose sponge 10. Electrical conductive plate 12 is attached to one face 14 of the sponge wafer 10. Opposing plate 16 is attached to the opposing face 18. As may be seen, the opposing plate is shown in the form of a wire. Also those with skill in the art will understand that the compressed dehydrated cellulose sponge is an expansion substance which expands upon contact with water. The wire, a portion of which forms the opposing plate 16, is bent upward through the sponge 10 to a head 20. As may be seen, the bridging portion 22 or that portion of the wire which bridges between the opposing plate 16 and the head 20 extends through a hole or opening or aperture 24 in the plate 12. There is a connection means 26 shown schematically which connects the connection device to battery 28 and alarm 30. As may be seen in FIG. 1, if moisture causes the sponge 10 to expand, it will force the plate 12 against the protuberance or head 20, which is a part of the bridging conductor and that this will make an electrical contact between the two plates, therefore, activating the alarm 30 as is well known in the art.

Referring to FIGS. 2, 3 and 4 is shown another embodiment. In this embodiment, again a plate or wafer of compressed dehydrated cellulose sponge 32 is used. In this case, the first main face has an adhesive 34 covering first main face 36, hinge edge 38 and opposing face 40. A water resistent adhesive is used.

First conductive plate 42 is attached to the adhesive on the first face 36 of the wafer 32. As it may be seen in the drawings, the first plate 42 is corrugated. We prefer to corrugate it because we prefer to use an extremely thin conductive plate herein, therefore, the corrugation give additional rigidity to the material. Also, it may be seen that the plate 42 extends at area 44 beyond the hinge edge 38.

On the opposing face 40, opposing electrical conductive plate 46 is attached by the adhesive 34. The opposing conductive plate may be planar, as seen in FIG. 2, or it also may be corrugated, as seen in FIGS. 3 and 4. It also extends in an area 48. It is necessary that the extension 44 of the plate 42 and the extension 48 of the plate 46 be greater than the distance across the hinge edge 38. Therefore, when the sponge wafer 32 swells because of contact with moisture it will cause the edge of the shorter extension to bite into the surface of the longer extension. As illustrated, it may be seen that the first extension 44 is shorter than the opposing extension 48 and, therefore, the edge of the corrugations on 44 will bite into the surface of the extension 48. Analysis will show that the plates are pivoted, i.e., the hinge edge 38 forms the fulcrum of a lever and, therefore, since the extensions 44 and 48 are of lesser length than the face 36 or opposing face 40 the force by which the plates are forced together is greater. Also, the extension 44 and 48 could be considered bridging conductors which electrically connect the two connector plates.

Suitable connectors 26 are attached as by soldering to the plates 42 and 46.

As may be seen, plates 42 and 46 do not extend to the edge opposite the hinge edge 38, providing greater surface by which the wafer 32 may absorb water. Although the drawings show the adhesive to cover this portion of the wafer, under certain manufacturing conditions it might be that this portion of the wafer 32 would not be covered with the adhesive 34, thereby giving even greater access of the wafer to moisture on its supporting surface.

Therefore, it may be seen that we have designed very simple, but very effective, moisture detectors which may be manufactured inexpensively and yet be very rugged and have a long shelf life. Because of ability to manufacture them so inexpensively, obviously it would be possible to use three or four of these beneath each water heater so as to be able to detect any moisture or leakage whatsoever in different locations around the water heater. It would also be possible to use them in attics to detect a leak in roofs or in basements to detect seeping water or to be used under sinks to detect drainage leaks. Because of the low expense and long shelf life, they could be used in many locations.

In some embodiments, such as FIG. 1, the top plate could be in the form of a conductive paint such as an aluminum paint which is applied to the sponge as by dipping or spraying.

As an aid to correlating the terms of the claims to the exemplary drawing, the following catalog of elements is provided:

10 sponge
12 plate
14 face
16 opposing plate
18 opposing face
20 head
22 bridging portion
24 aperture
26 connection
28 battery
30 alarm
32 wafer
34 adhesive
36 first face
38 hinge edge
40 opposing face
42 plate
44 area
46 opposing plate
48 opposing area The embodiments shown and described above are only exemplary. We do not claim to have invented all the parts, elements or steps described. Various modifications can be made in the construction, material, arrangement, and operation, and still be within the scope of our invention. The limits of the invention and the bounds of the patent protection are measured by and defined in the following claims. The restrictive description and drawing of the specific examples above do not point out what an infringement of this patent would be, but are to enable the reader to make and use the invention.

I claim as my invention:

1. In a water leak alarm system having
a. a source of electrical energy,
b. an alarm,
c. a detector including a two faced expansion wafer which expands upon contact with water,
d. a connection means for connecting the source of electrical energy and alarm to the detector;
the improved method of detecting moisture comprising:
e. hinging said wafer at one edge,
f. attaching a plate to one face of the wafer which plate extends beyond the hinged edge,
g. attaching an opposing plate to an opposing face of the wafer which plate extends beyond the hinged edge,
h. opening the plates by expansion of the wafer, and thereby
j. levering the extensions into contact.

2. In a water leak alarm system having
a. a source of electrical energy,
b. an alarm,
c. a detector including an expansion substance which expands upon contact with water,
d. a connection means for connecting the source of electrical energy and alarm to the detector;
the improved moisture detector comprising:
e. a first electrical conductor plate adhered to one face of said expansion substance,
f. an opposing plate adhered to an opposing face of said expansion substance,
g. a bridging conductor attached to said opposing plate and extending proximate the first plate conductor
h. so that expansion of the substance causes the bridging conductor to electrically connect the conductor plates,
j. said expansion substance means is compressed dehydrated cellulose sponge.

3. In a water leak alarm system having
a. a source of electrical energy,
b. an alarm,
c. a detector including an expansion substance which expands upon contact with water,
d. a connection means for connecting the source of electrical energy and alarm to the detector;
the improved moisture detector comprising:
e. a first electrical conductor plate adhered to one face of said expansion substance, f. an opposing plate adhered to an opposing face of said expansion susbstance, g. a bridging conductor attached to said opposing plate and extending proximate the first plate conductor h. so that expansion of the substance causes the bridging conductor to electrically connect the conductor plates, j. said substance being in the form of a two faced wafer, k. one edge of said wafer being hinged so the two faces of the wafer along said edge cannot move apart along that edge, m. said conductor plates extending beyond said hinge thus forming said bridging conductor whereby expansion of said wafer causes the wafer to fan open causing said conductor plates to be levered together on the briding conductor.

4. The invention as defined in claim 3 wherein n. said expansion substance means is compressed dehydrated cellulose sponge.

* * * * *